US006631818B1

(12) United States Patent
Ito

(10) Patent No.: US 6,631,818 B1
(45) Date of Patent: Oct. 14, 2003

(54) OVERHEAD TRAVELING CRANE SYSTEM

(75) Inventor: Katsuto Ito, Hitachi (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/700,238

(22) PCT Filed: May 14, 1999

(86) PCT No.: PCT/JP99/02496

§ 371 (c)(1),
(2), (4) Date: Apr. 18, 2002

(87) PCT Pub. No.: WO99/58441

PCT Pub. Date: Nov. 18, 1999

(30) Foreign Application Priority Data

May 14, 1998 (JP) ..... 10-132090

(51) Int. Cl.[7] ..... C25C 7/06
(52) U.S. Cl. ..... 212/330; 118/423; 134/76
(58) Field of Search ..... 212/281, 330, 212/331; 118/423; 134/76

(56) References Cited

U.S. PATENT DOCUMENTS 3,850,305 A * 11/1974 Messina ..... 212/281
4,392,506 A * 7/1983 Tanaka et al. ..... 134/46
4,657,470 A * 4/1987 Clarke et al. ..... 414/627
4,747,313 A * 5/1988 Okada ..... 73/862.04
5,145,227 A * 9/1992 Monford ..... 294/65.5

FOREIGN PATENT DOCUMENTS

JP 55-11382 * 8/1980

* cited by examiner

*Primary Examiner*—Thomas J. Brahan
(74) *Attorney, Agent, or Firm*—Leighton K. Chong; Ostrager Chong & Flaherty

(57) ABSTRACT

An overhead traveling crane system, wherein at least two locking members (25*a*) are mounted vertically slidably on a lifting device (15), a stopper (25*b*) and a contact member are fixed to the upper and lower end parts of each locking member (25*a*), respectively. A non-contact sensing device is fixed to the underside of the lifting device (15), and a sensor element (27) is fixed to the locking members (25*a*). The lowering of the locking members (25*a*) is stopped when the contact means is brought into contact with a reference position, and the lowering of the lifting device (15) is stopped when the lifting device (15) is lowered further so as to move the sensing device on the lifting device (15) side closely to the sensor element on the locking members (25*a*). Even though a general-purpose overhead traveling crane is used, the vertical positioning accuracy of the lifting device installed on the overhead traveling crane is increased.

6 Claims, 5 Drawing Sheets

OVERHEAD TRAVELING CRANE SYSTEM

This U.S. patent application claims the priority of PCT International Application No. PCT/JP99/02946, filed on May 14, 1999, which was based on the priority of Japanese Patent Application No. 10-132090, filed on May 14, 1998.

TECHNICAL FIELD

This invention relates to an overhead traveling crane system capable of accurately controlling the position of a lifting device horizontally, the lifting device being suspended from the overhead traveling crane system and elevated thereby.

BACKGROUND ART

First, a description will be given of an outline of an electrolysis refinery facility (see FIG. 6). An electrolytic bath 30 is formed as a rectangular parallelepiped tank which is open upwardly and has a common conductor (bus bar) 32 set up on an upper surface of a side wall 30*c* of the electrolytic bath 30. As is most clearly shown in FIG. 5, a plurality of electrolytic baths 30 are arranged side by side longitudinally and laterally, and they come to several hundreds of tanks in total. In an electrolyte solution of each electrolytic bath 30, a plurality of cathode plates K (in case of Cu, normally between 20 and 50 sheets) and a plurality of anode plates A with lugs immersed alternately in parallel. Each of the cathode plates K is suspended from a cathode support bar (cross bar) 34. Both ends of the cross bar 34 as well as the lugs of the anode plates A are supported on an upper surface of one of left and right electrolytic bath side walls 30*c* and a common conductor provided to the other side wall 30*c*, respectively. In the electric current supply of a system as shown in FIG. 5, four electrolytic baths 30 are arranged in two rows longitudinally and two rows laterally to make one set, and are wired so that electric current flows from the anode plates A to the cathode plates K. Because an electrolysis refinery power source needs low voltage and a large amount of current and has, at the same time, a wide range of voltage adjustment depending on a condition of an electrolysis operation, a semiconductor rectifier of a thyristor system or a diode system is employed.

As primary factors that hamper normal operation of the electrolysis refinery, there are growths of branch shaped crystals or lumps on the cathode side, curvature of the cathode, and bridging of large anode fragments. For example, if a lump grows locally on the cathode side and hypertrophies, anode plate A and cathode plate K will short-circuit, so that the electrolysis current becomes concentrated on the short-circuited area, and the electrolysis refinery is hampered.

Tank inspection work to discover these errors is done by workmen walking on the electrolytic baths everyday. But this demands a great deal of labor because enormous parts must be inspected and workmen walking on the electrolytic baths may cause the position of an electrode plate to shift.

Accordingly, by utilizing the fact that the gain and loss of electric current and variation in magnetic flux have a certain relationship, the system is designed to measure the magnetic-flux density of the cathode plates K and/or anode plates A with a magnetic sensor and detect change of the electric current and to thus detect any error on the electrode plate. Furthermore, to make the inspection work automatic for measurement of the magnetic-flux density, the system is designed to utilize an overhead traveling crane system for salvaging electrode plates, suspending the lifting device from it, mounting a plurality of magnetic sensors on this lifting device, and placing each of the magnetic sensors adjacent to the cathode plates K and/or anode plates A supported by common conductors.

To measure the magnetic-flux density of each of the electrode plates, it is required that the overhead traveling crane system accurately positions the magnetic sensors close to the given places of the cathode plates K and anode plates A.

However, with the general-purpose model of the overhead traveling crane system, in addition to possible error like a rail construction error or a detector error, since there is only a little space between the system and each of the electrode plates (approximately 10 cm), it is usually difficult to operate the overhead traveling crane system to accurately position the magnetic sensors suspended from the lifting device close to the cathode plates K and/or anode plates A.

To minimize the error, it is conceivable to carry out the construction of the rail more minutely and suppress the play in oblique and lateral wheel movement to the utmost. However, in practice, it is extremely difficult to do so in a facility with the rail being several hundred meters long.

Moreover, if the elevation of the lifting device is based on the height measured in only one spot, the magnetic sensors might be displaced from their given positions close to the cathode plates K and/or the anode plates A by the inclination of the lifting device, and might not be able to measure the magnetic-flux.

Therefore, this invention has an object to provide a stopping device for stopping movement of a lifting device vertically in an overhead traveling crane system with an increased accuracy even when a general-purpose overhead traveling crane is used.

SUMMARY OF THE INVENTION

To solve the above-mentioned problem, the invention provides a stopping device for a lifting device of an overhead traveling crane system in which a moving device is arranged so as to be movable in a horizontal direction on a track laid on an upper space, and the lifting device is suspended from the moving device through a wire so as to ascend and descend, and wherein the stopping device descends and stops the lifting device to a given height with respect to a reference position defined on the ground. At least two locking members are attached to the lifting device so as to slide with it in up and down directions. A stopper is attached to an upper end of each of the locking members in order to prevent the locking members from falling off the lifting device. Contacting means are fixed to a lower end of each of the locking members in order to cause the locking members to stop descending by coming into contact with the reference position. Sensing devices are attached to given positions on the lifting device, and sensor elements to be sensed by the sensing devices are attached to the locking members. The locking members are caused to stop descending when the contacting means makes a contact with the reference position. The lifting device continues to descend until the sensing devices attached to the lifting device sense the sensor elements attached to the locking members, and then the lifting device is caused to stop descending.

To solve the above-mentioned problems, the present invention provides the stopping device for stopping the lifting device in the height direction of the overhead traveling crane system. The sensing devices on the lifting device include three sensing devices arranged in a vertical direction. The locking members are caused to stop descending when the contacting means makes contact with the reference position. A lower one of the three sensing devices senses a corresponding one of the sensor elements, so that the lifting device is decelerated. The lifting device is caused to stop descending when a middle one of the three sensing devices senses the corresponding one of the sensor elements. The upper one of the three sensing devices causes an emergency stop of the lifting device when sensing the corresponding one of the sensor elements.

The present invention also provides the stopping device for stopping the lifting device in the height direction [in] of the overhead traveling crane system wherein the contacting means includes disks which have a size that can contact a plurality of cathode supporting rods and are supported so as to rotate in a circumference direction thereof, the disks being supported by the lifting device so as to slide vertically on a ball bushing.

The present invention further provides the stopping device for stopping the lifting device in the height direction of the overhead traveling crane system wherein one or more magnetic sensors are suspended from and supported by the lifting device.

Each of the magnetic sensors is fixed to a tip of a Teflon pole, so that the magnetic sensors can be prevented from being damaged due to bending of the Teflon pole caused when the magnetic sensors strike the cathode supporting rods. The attachment positions of the magnetic sensors can be adjusted.

BEST MODE FOR CARRYING OUT THE INVENTION

First, a description will be given of an outline of an overhead traveling crane system, and then a detailed description will be given of a preferred embodiment of a stopping device in the height direction of a lifting device of the overhead traveling crane system according to the present invention as shown in the accompanying drawings.

Figure 1:
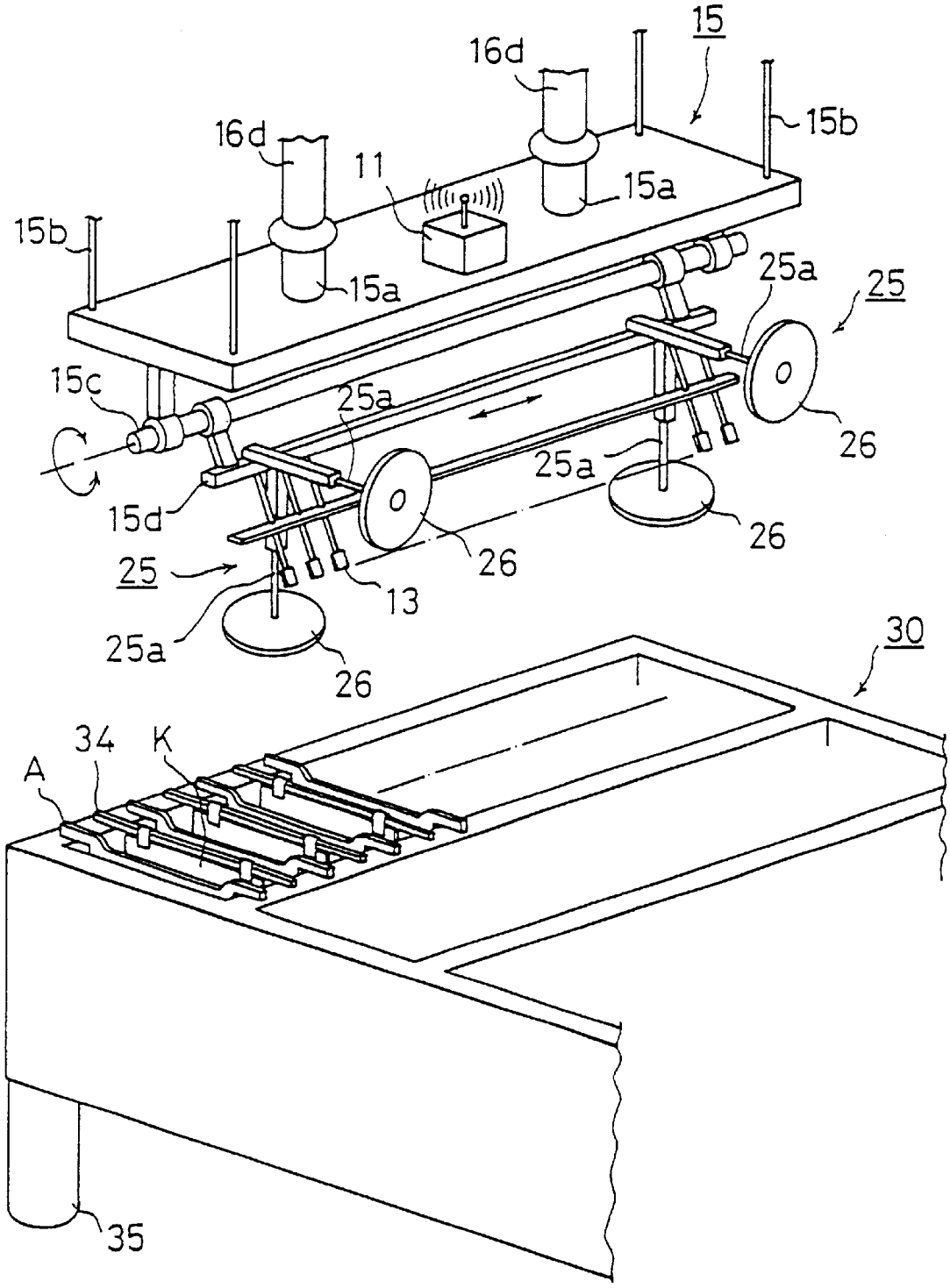
FIG. 1 is a schematic perspective view of a stopping device in the height direction of a lifting device of an overhead traveling crane system of the present invention.
Figure 2:
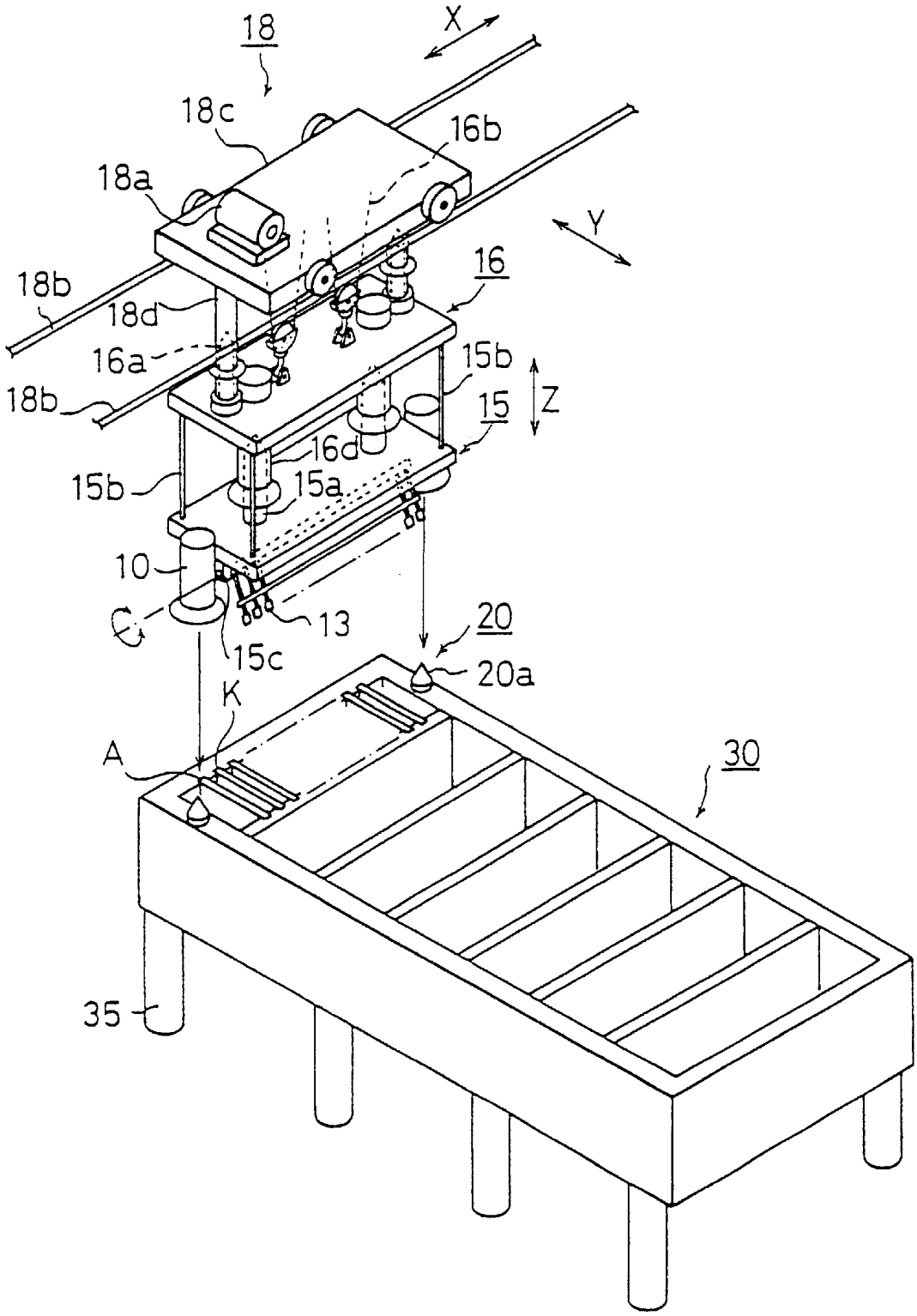
FIG. 2 is a perspective view of the whole overhead traveling crane system shown in FIG. 1.

FIG. 1 is a schematic perspective view of the stopping device in the height direction of the lifting device of the overhead traveling crane system according to an embodiment of the present invention, and FIG. 2 is a perspective view of the entire overhead traveling crane system shown in FIG. 1.

A large number of electrolytic baths 30 arranged for Cu refinery are formed as tanks containing an electrolyte solution like dilute sulfuric acid. The electrolytic baths 30 are framed and fixed as a whole, and are supported by a plurality of legs 35. Each electrolytic bath 30 has anode plates A serving as the anode electrodes and cathode plates K serving as the cathode electrodes arranged side by side. A positioning member 20 is installed on an upper part of a side of the electrolytic baths 30.

As shown in FIG. 2, the overhead traveling crane system is primarily made up of a moving device 18, a suspension member 16, a lifting device 15, a position guide member 10, the positioning member 20, and a locking device 25 attached to the underside of the lifting device 15 (see FIG. 1).

The moving device 18 is a device which horizontally travels in a longitudinal direction X or a lateral direction Y of the assembly of the electrolytic baths 30 arranged side by side (in FIG. 2, only a plurality of electrolytic baths 30 in the lateral direction Y are illustrated). The moving device 18 has a slider 18*c*, which travels in the X-axis direction on rails 18*b* and is equipped with a motor 18*a*. Moreover, the rails 18*b* are laid in a frame which is not shown in the figures and this frame travels in the Y-axis direction.

Attached to the lower surface of the slider 18*c* is a pair of first cylindrical guide members 18*d*, which have flared parts located below the lower side. The suspension member 16 is suspended from the lower surface of the slider 18*c* via wires 16*b* to be elevated thereby.

A pair of first guide bars 16*a* is vertically provided on the upper surface of the suspension member 16 and is to be inserted into the pair of first cylindrical guide members 18*d* attached to the lower surface of the slider 18*c*. This prevents the suspended suspension member 16 from swinging due to inertia force caused when the moving device 18 travels horizontally.

A pair of second cylindrical guide members 16*d* is attached to the lower surface of the suspension member 16. The lower ends of the second cylindrical guide members 16*d* are flared to a wider opening.

A pair of second guide bars 15*a* is attached to the upper surface of the lifting device 15 so as to be inserted into the second cylindrical guide members 16*d*. This, as described above, prevents the swinging of the lifting device 15 when the moving device 18 travels laterally.

The upper ends of the second guide bars 15*a* are supposed to be received in the flared parts of the second cylindrical guide members 16*d* immediately after the lifting device 15 arrives at a given position and descends so that the position guide means 10 starts to engage with the positioning member 20.

Until the position guide member 10 and the positioning member 20 completely engage with each other, the upper ends of the second guide bars 15*a* are movable inside the flared parts of the second cylindrical guide members 16*d*.

The position guide member 10 is provided on the top part of the side wall of the assembly of electrolytic baths 10 and becomes engaged with the positioning members 20 provided on both sides of the lifting device 15.

An attachment shaft 15*c* is attached to the underside of the lifting device 15 in the longitudinal (X-axis) direction and a magnetic sensor installation frame 15*d* is provided so that it swings about the attachment shaft 15*c* and moves in the longitudinal direction.

A plurality of magnetic sensors 13 are mounted on the magnetic sensor installation frame 15*d* to measure the magnetic-flux of the cathode side or the anode side at the same time.

Figure 6:
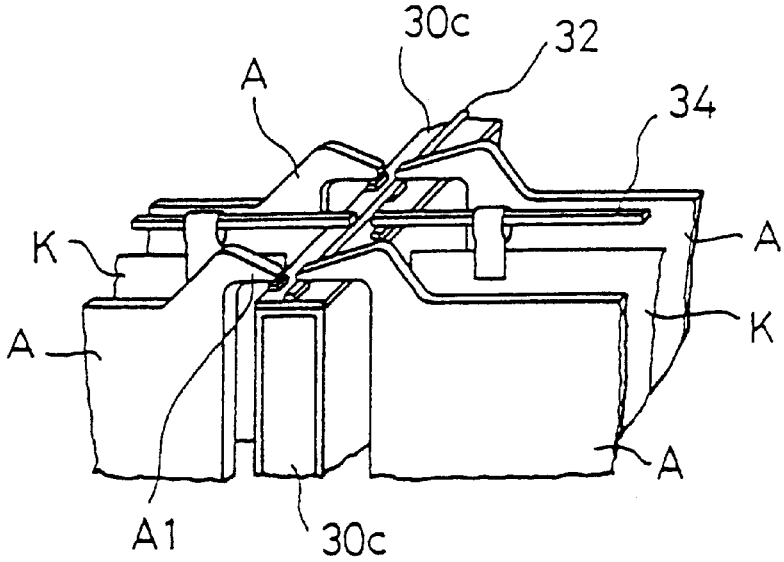
FIG. 6 is a perspective view showing details of electrical connection of anode plates and cathode plates in an electrolysis refinery.

The reason why the above-mentioned structure is employed is that, as shown in the FIG. 6, both ends of the cross bar 34 and the edges of the anode plates A are supported by the common conductor 32 set up on the top part of one of the side walls 30*c* of the electrolytic baths and the other side wall 30*c*. Therefore, the position to measure the magnetic-flux of the cathodes K and the position to measure the magnetic-flux of the anodes A have to be opposite to the side walls 30*c* of the electrolytic bath, respectively.

It is possible to install the sensors to measure the magnetic-flux of the cathodes K and anodes A on the lifting device 15, but this will require installation of [an] approximately twice the number of magnetic sensors, incurring more cost, and increasing the weight also.

With the above in mind, the attachment shaft 15*c* which can swing in the X-axis direction is provided, and the magnetic sensors 13 are attached to the attachment shaft 15*c* to make it possible to measure the magnetic-fluxes of both the cathodes K and anodes A.

However, the positions where the cathodes K and the anodes A are supported by the common conductor 32 have a displacement of approximately 5 cm gap. For that reason, the magnetic sensors 13 cannot easily approach the measuring positions on the anode A side by just having it swung after measurement on the cathode K side. Thus, a straight line traveling guide mechanism is provided to the magnetic sensor installation frame 15*d* to make it possible to travel in the X-axis direction.

Each of the magnetic sensors 13 is attached to the tip end of a Teflon pole. In case the magnetic sensors 13 strike the cathode supporting rod 34 or the side wall 30*c* of the electrolytic bath, the Teflon pole will be bent to prevent the magnetic sensors 13 from being damaged.

Since the magnetic sensors 13 need to be placed accurately at positions close to the cathode plates K and/or the anode plates A, the attachment points on the magnetic sensor installation frame 15*d* is adjustable with a screw.

Furthermore, in the present embodiment, the same number of magnetic sensors 13 as that of the cathode plates K is installed.

As shown in FIG. 1, in the present embodiment, the stopping device 25 is attached to the lower part of the lifting device 15 by the magnetic sensor installation frame 15*d*.

The stopping device 25 is primarily made up of locking members 25*a*, stoppers 25*b*, disks 26, sensed bodies 27, deceleration sensors 29*a*, stopping sensors 29*b*, and emergency stopping sensors 29*c*.

Figure 3:
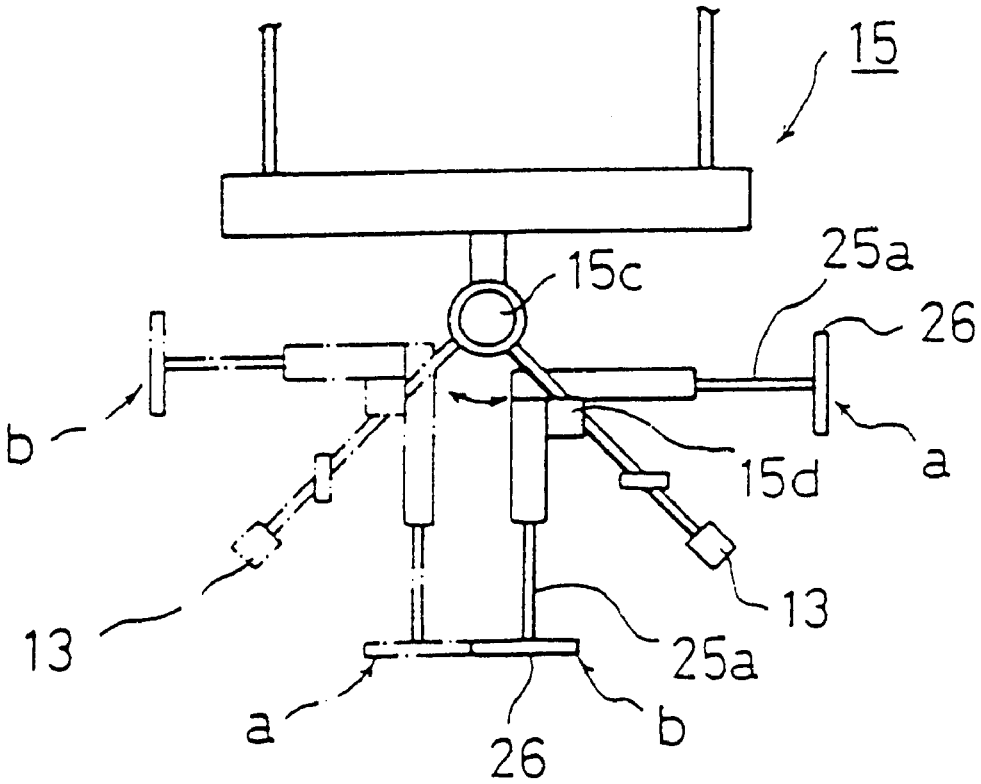
FIG. 3 is a schematic side view of an installation position of a locking member.

In the present embodiment, the magnetic sensors 13 are arranged so as to swing in order to measure the magnetic-flux at the upper surfaces of both the right and left side walls 30*c* of the electrolytic bath. As shown in FIG. 3, the locking members 25*a* are placed in the directions of 45 degrees from the center of the attachment shaft 15*c* with respect to the magnetic sensors 13. Two of the locking members 25*a* are installed slidably on the magnetic sensor installation frame 15*d*, and the remaining two locking members 25*a* are attached to both ends of the edges of the magnetic sensor installation frame 15*d* in the longitudinal direction With the above-mentioned structure, even when each magnetic sensor 13 is turned to either the left or right side wall 30*c* of the electrolytic bath, it will be possible to position either one of the locking members 25*a* in the perpendicular direction. In other words, the "b" member moves when the magnetic sensor 13 is placed in the right 45-degree direction, and the "a" member moves when the magnetic sensor 13 is placed in the left 45-degree direction (see FIG. 3).

Thus, the present embodiment has four locking members 25*a* in total, two being provided on one end of the magnetic sensor installation frame 15, and the two others being provided on the other end thereof.

The reason the locking members 25*a* are installed in two places on both ends of the magnetic sensor installation frame 15*d* is to prevent the lifting device 15 from becoming inclined when independently controlling two motors (not shown in the figures) to raise and lower the lifting device 15.

The stopper 25*b* is attached to the top end of each locking member 25*a* in order to prevent the locking member 25 from dropping out. The disk 26 is attached to the bottom end of each of the locking members 25*a* as a contacting means for making contact with a base position used as a starting point for positioning, and is free to rotate in the circumference direction. After contacting the plurality of cathode supporting rods 34, the disks 26 are movable so as to slide on the top surfaces thereof in the X and Y directions until the positioning is completed.

Each disk 26 has a diameter which makes it possible to contact the cathode supporting rods 34 even when the positioning error in the X direction is the maximum amount of error of the moving device 18. The sensor element 27 is sensed by a non-contact type sensing device and is attached in a given position on each locking member 25*a*.

In the present embodiment, in order to avoid the locking members 25*a* getting caught in the magnetic sensor installation frame 15*d*, a ball bushing is used as the locking member 25*a* and a bearing is used for attachment to the magnetic sensor installation frame 15*d* so that the locking members 25*a* can slide smoothly.

Provided on both ends of the magnetic sensor installation frame 15*d* set close to the locking devices 25*a* are the deceleration sensor 29*a*, the stopping sensor 29*b*, and the emergency stopping sensor 29*c* in order from the bottom. These sensors act as sensing devices which act on the sensor element 27 when it comes close. When each of the sensors senses the sensor element 27, the respective signals are sent to an elevation motor (not shown in the figures) so that the motor decelerates the speed, stops, or makes an emergency stop.

In the present embodiment, non-contact type proximity switches are used as the sensing devices, but it is possible to employ contact-type limit switches.

Next, a description will be given of an operation of the stopping device in the height direction of the overhead traveling crane system.

The frame (not shown in the figures) and/or the slider 18*c* is moved horizontally to position the lifting device 15 over the target electrolytic bath 30. If there is an obstacle during traveling, the second wires 15*b* are wound up, and the first wires 16*b* are wound up so that the height of the lifting device 15 can be adjusted. The lifting device 15 stops moving when the moving device 18 arrives at the given position. The first cylindrical guide members 18*d* and the second cylindrical guide members 16*d* prevent the lifting device 15 from swinging caused by the inertia due to the movement of the moving device 18.

Afterwards, the elevation motor (not shown in the figures) is initiated to wind down the second wires 15*b*, so that the lifting device 15 descends.

Figure 4:
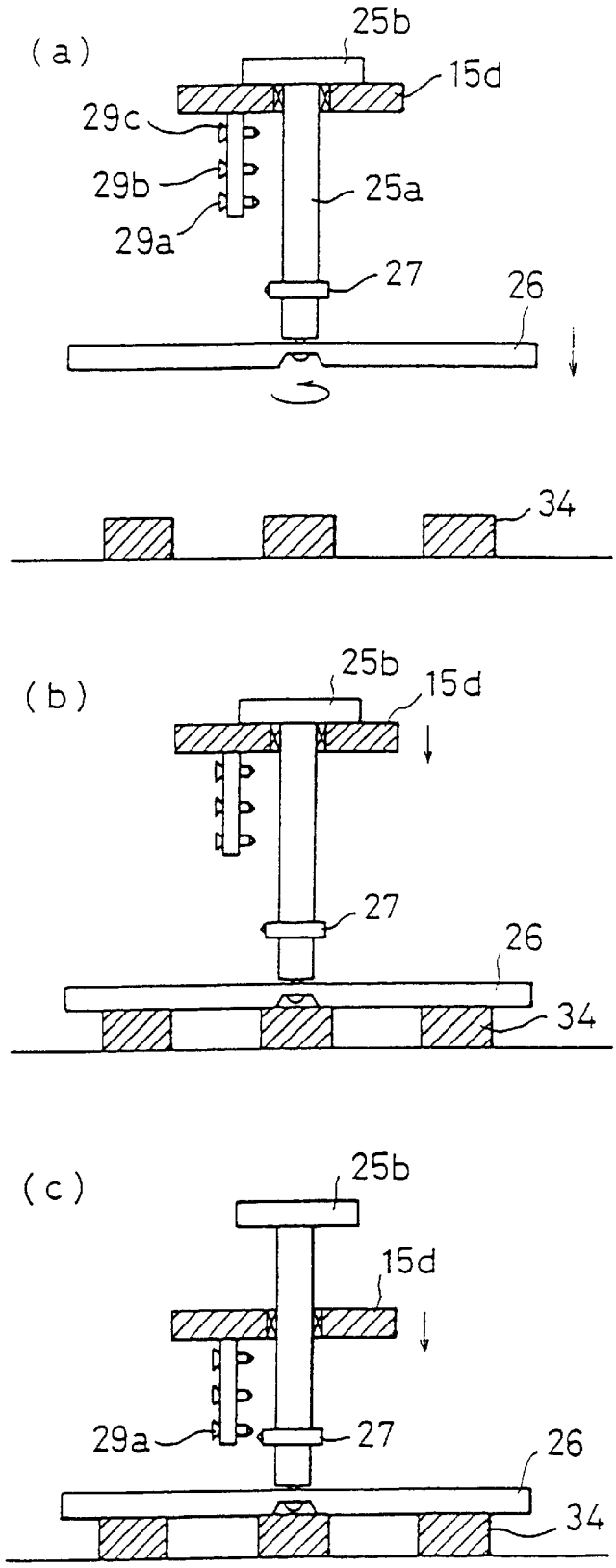
FIG. 4 is a cross-sectional view showing a movement of the locking member.
Figure 5:
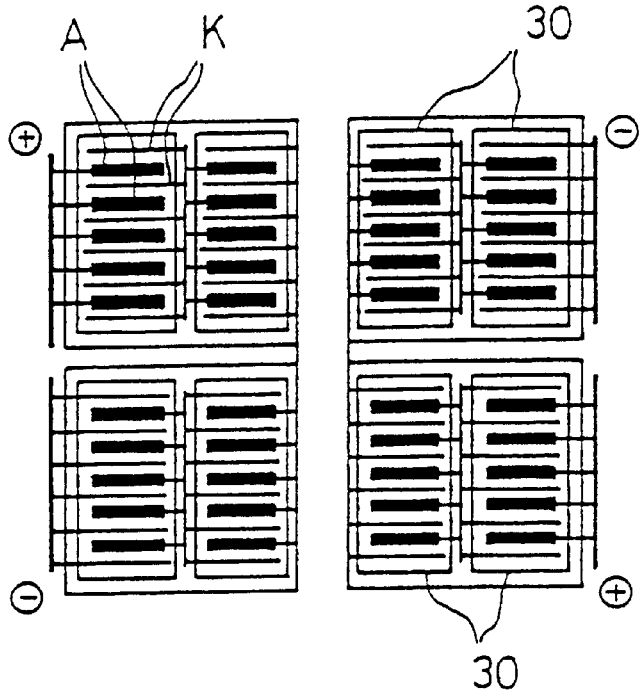
FIG. 5 is a schematic plan view for explaining an electric supply system to electrolytic baths.

When the lifting device 15 descends, the disks 26 attached to the bottom sides of the two locking devices 25*a* come close to the cathode supporting rods 34 (see FIG. 4(*a*)) and are brought into contact therewith (see FIG. 4(*b*)).

When the disks 26 contact the cathode supporting rods 34, the locking members 25*a* stop descending, while the lifting device 15 will continue to descend because the attachment part thereof with respect to the magnetic sensor installation frame 15*d* is slidable.

As the lifting device 15 continues to descend, of the sensors attached to the magnetic sensor installation frame 15*d*, the deceleration sensor 29*a* first comes close to the sensor element 27 (see FIG. 4(*c*)). When the deceleration sensor 29*a* senses the sensor element 27, it generates a signal to decelerate the motor. The motor starts decelerating after it receives the signal, and the descending speed of the lifting device 15 is reduced.

If the elevation motor does not stop, the sensor element 27 comes close to the emergency stop sensor 29, which senses the sensor element 27 and generates a signal for emergency stop of the elevation motor. The above signal causes an emergency stop of the elevation motor and emergency stop of the lifting device 15.

A sequence of the actions mentioned above is done independently in two places at both ends of the magnetic sensor installation frame 15*d*.

In connection with the above-mentioned actions, as the lifting device 15 descends, the flared openings of the position guide members 10 draw near engaging members 20*a* attached to on the positioning members 20, and soon the engagement begins.

The lifting device 15 keeps descending further, and the flared position guide member 10 moves along the side surfaces of the conical engaging members 20*a*. The lifting device 15 finely moves in the horizontal direction so that the large number of magnetic sensors 13 can be accurately placed in given positions close to the cathode plates Ks. The position control to the magnetic sensors 13 is done as described above, so that the flared position guide member 10 finally engages with the conical engaging members 20*a*. Then, the magnetic-flux on the cathode K side is measured.

After the measurement of the magnetic-flux at the stated position, the second wires 15*b* are wound up, and the lifting device 15 is raised. Then, the magnetic sensor installation frame 15*d* is caused to swing at an angle of 90 degrees in the direction of the anode plates A and to move approximately 5 cm in the axial direction.

Afterwards, the second wires 15*b* are wound up to raise the lifting device 15, and the moving device 18 is moved horizontally. Then, the lifting device 15 is moved to the next target position above the electrolytic bath 30, and the above operation is repeated.

In the present embodiment, the cathode supporting rod is the base for the positioning of the height direction of the lifting device, so it is possible to improve the precision of the positioning even though the height position of the rails of the overhead traveling crane has a large error.

The height detection from the top is done with the cathode supporting rods as the base for the height position. Therefore, the positioning is possible even if a warm retaining sheet is placed on top of the electrolytic baths.

By setting up the locking members in two places so that each of the members controls the respective motor individually, it is possible to stop at the given position without the lifting device tilting.

A screw is installed to adjust the attachment position of the magnetic sensors. Therefore, it is possible to arrange the magnetic sensors 13 at the given height even when the lifting device and the magnetic sensor installation frame 15*d* become contorted.

By having the magnetic sensors installed on the tip of the Teflon pole, the Teflon pole will be bent to protect the magnetic sensors from damage even if the magnetic sensors strikes the cathode supporting rods.

What is claimed is:

1. A lifting device of an overhead traveling crane system of the type having a moving device movable on an upper track and suspending the lifting device from the moving device through motor-driven wires so as to ascend and descend with respect to a reference position on the ground, wherein said lifting device is used to position one or more magnetic sensors in a given position for detecting a magnetic condition of a target at the reference position on the ground, comprising:

at least two spaced-apart locking members slidably engaged on respective opposing ends of a lower part of the lifting device so as to be slidable in up and down directions with respect to each lifting device end, wherein a stopper is attached to an upper end of each of the locking members in order to prevent it from disengaging from the lifting device, and a contacting means is fixed to a lower end of each of the locking members in order to cause it to stop descending and slide relative to the lifting device when the contacting means comes into contact with the target at the reference position on the ground, one or more sensing devices attached to given positions on the lifting device adjacent each locking member, and a sensor element fixed at a predetermined position on each locking member for providing a motor-control signal to control or stop the descent of the lifting device when the sensor element is moved in proximity to the sensing devices during sliding movement of the locking member relative to the lifting device, wherein each of the locking members is stopped from descending when the contacting means make contact with the target at the reference position, and the respective end of the lifting device can continue to descend until the sensing devices attached to the lifting device can sense the sensor element attached to each locking member and provide the motor-control signal to cause the lifting device to stop descending, and wherein the one or more magnetic sensors are suspended from and supported on the lower part of the lifting device and become positioned precisely for detecting a magnetic condition of the target at the reference position when the sensing devices sense the sensor elements attached to the locking members and provide the motor-control signal to cause the lifting device to stop descending.

2. A lifting device as claimed in claim 1, wherein the sensing devices on the lifting device include three sensing devices arranged in a vertical direction, and when the lower one of the three sensing devices senses the sensor element on the slidable locking member, a first motor-control signal is provided for decelerating the lifting device, when the middle one of the three sensing devices senses the sensor element, a second motor-control signal is provided for stopping the descent of the lifting device, and when the upper one of the three sensing devices senses the sensor element, a third motor-control signal is provided for making an emergency stop of the lifting device.

3. A lifting device as claimed in claim 1, wherein the contacting means is a disk having a size which can contact the target at the reference position on the ground, and the locking member is in the form of a ball bushing slidable in a bearing attached to the lower part of the lifting device.

4. A lifting device as claimed in claim 1, wherein each of the magnetic sensors is attached to a tip of a pole made of elastic material, so that the magnetic sensors can be prevented from being damaged by the pole bending when the magnetic sensors are positioned for detecting a magnetic condition of the target at the reference position.

5. A lifting device as claimed in claim 4, wherein the magnetic sensors are adjustable in their attachment positions to the poles.

6. A lifting device as claimed in claim 1, wherein the magnetic sensors are mounted on a rotatable horizontal bar supported from the lower part of the lifting device, and two pairs of spaced-apart locking members are arranged on the horizontal bar at different rotation angles from each other, such that one pair of locking members is used to stop the descent of the lifting device when the magnetic sensors are positioned at one angular position proximate the target, and the other pair of locking members is used to stop the descent of the lifting device when the horizontal bar is rotated to position the magnetic sensors at another angular position proximate the target.

* * * * *